US008734600B2

(12) United States Patent
Hashimura et al.

(10) Patent No.: US 8,734,600 B2
(45) Date of Patent: May 27, 2014

(54) HIGH STRENGTH STEEL WIRE FOR SPRING

(75) Inventors: Masayuki Hashimura, Tokyo (JP); Hitoshi Demachi, Tokyo (JP); Takayuki Kisu, Tokyo (JP); Shoichi Suzuki, Narashino (JP); Motonobu Suehiro, Narashino (JP); Jun Kawaguchi, Narashino (JP); Keiichi Maekawa, Wako (JP); Atsushi Murakami, Wako (JP)

(73) Assignees: Nippon Steel & Sumitomo Metal Corporation, Tokyo (JP); Suzuki Metal Industry Co., Ltd., Tokyo (JP); Honda Motor Co., Ltd., Tokyo (JP)

( * ) Notice: Subject to any disclaimer, the term of this patent is extended or adjusted under 35 U.S.C. 154(b) by 80 days.

(21) Appl. No.: 13/261,124

(22) PCT Filed: Jul. 9, 2010

(86) PCT No.: PCT/JP2010/062025

§ 371 (c)(1), (2), (4) Date: Jan. 30, 2012

(87) PCT Pub. No.: WO2011/004913

PCT Pub. Date: Jan. 13, 2011

(65) Prior Publication Data

US 2012/0125489 A1 May 24, 2012

(30) Foreign Application Priority Data

Jul. 9, 2009 (JP) ..... 2009-162784

(51) Int. Cl.
*C22C 38/22* (2006.01)
*C22C 38/24* (2006.01)

(52) U.S. Cl.
USPC ..... 148/334; 148/908

(58) Field of Classification Search
USPC ..... 148/334, 908, 595, 598, 599, 580
See application file for complete search history.

(56) References Cited

U.S. PATENT DOCUMENTS

2008/0279714 A1* 11/2008 Hashimura et al. ..... 420/118
2009/0205753 A1 8/2009 Hashimura et al.
2010/0028196 A1* 2/2010 Hashimura et al. ..... 420/84

FOREIGN PATENT DOCUMENTS

CN 101321884 12/2008
JP 2000-169937 6/2000
JP 2002-180198 6/2002

(Continued)

OTHER PUBLICATIONS

International Search Report dated Oct. 19, 2010 issued in corresponding PCT Application No. PCT/JP2010/062025.

*Primary Examiner* — Deborah Yee
(74) *Attorney, Agent, or Firm* — Kenyon & Kenyon LLP

(57) ABSTRACT

High strength steel wire for spring containing, by mass %, C: 0.67% to less than 0.75%, Si: 2.0 to 2.5%, Mn: 0.5 to 1.2%, Cr: 0.8 to 1.3%, V: 0.03 to 0.20%, Mo: 0.05 to 0.25%, W: 0.05 to 0.30%, and N: 0.003 to 0.007%, having a total of contents of Mn and V of 0.70%≤Mn+V≤1.27% and a total of contents of Mo and W of 0.13%≤Mo+W≤0.35%, limiting P: 0.025% or less, S: 0.025% or less, and Al: 0.003% or less, and having a balance of iron and unavoidable impurities, having a microstructure comprised of, by volume percent, over 6% to 15% of retained austenite and tempered martensite, having a prior-austenite grain size number of 10 or more, having a density of presence of spheroidal carbides with a circle equivalent diameter of 0.2 to 0.5 μm of 0.06 particles/$\mu m^2$ or less, having a density of presence of spheroidal carbides with a circle equivalent diameter of over 0.5 μm of 0.01 particles/$\mu m^2$ or less, and having a tensile strength of 2100 to 2350 MPa.

3 Claims, 3 Drawing Sheets

(56) References Cited

FOREIGN PATENT DOCUMENTS

| | | |
|---|---|---|
| JP | 2002-235151 | 8/2002 |
| JP | 2003-3241 | 1/2003 |
| JP | 2004-190116 | 7/2004 |
| JP | 2006-183137 | 7/2006 |
| JP | 2006-342400 | 12/2006 |
| WO | 2007/114491 | 10/2007 |
| WO | WO 2007/114491 | 10/2007 |

* cited by examiner

HIGH STRENGTH STEEL WIRE FOR SPRING

This application is a national stage application of International Application No. PCT/JP2010/062025, filed 09 Jul. 2010, which claims priority to Japanese Application No. 2009-162784, filed 09 Jul. 2009, which is incorporated by reference in its entirety.

TECHNICAL FIELD

The present invention relates to steel wire used as a material for high-strength spring which is produced by being cold coiled and further treated by heat treatment, nitridation, shot peening, etc.

BACKGROUND ART

Along with the lighter weight and higher performance of automobiles, the load on the valve springs of the automobile engines, suspension springs of the suspension systems, clutch springs, brake springs, and other springs has increased. In recent years, high strength steel wire for spring with a tensile strength of over 2000 MPa has therefore been sought.

When producing high strength spring, the material, that is, high strength steel wire for spring, is coiled cold (cold coiling) and, furthermore, is treated by stress-relief annealing or other heat treatment and nitridation. For this reason, high strength steel wire for spring is required to be kept down in softening due to heating, that is, is required to have temper softening resistance.

Further, a spring is required to have fatigue properties, so high strength steel wire for spring is used as a material and, furthermore, nitridation and shot peening are performed to raise the hardness of the surface layer of the spring.

However, among the aspects of durability of springs, the settling properties are not determined by the hardness of the surface layer. The hardness of the base material of the spring also has a large effect. For this reason, for improving the settling properties as well, the temper softening resistance of the high strength steel wire for spring is important.

Furthermore, in the case of cold coiling, when producing the material of high strength steel wire for spring, it is possible to use oil temper treatment, induction heating treatment, etc. which enable rapid heating and rapid cooling. For this reason, it is possible to reduce the size of prior-austenite grains of the spring steel wire and obtain a spring excellent in breakage properties.

However, if steel wire for spring becomes higher in strength, in cold coiling, breakage will occur and the wire will not be able to be shaped into a spring.

To deal with this problem, some of the present inventors proposed high strength steel wire for spring controlled in retained austenite, nonmetallic inclusions, carbides, etc. (for example, see PLTs 1 to 6).

The high strength steels for spring proposed in PLTs 1 and 2 suppress the formation of retained austenite which transforms to strain induced martensite due to cold coiling and causes the workability to drop and suppress nonmetallic inclusions which become starting points of fracture.

Further, the high strength steel for spring proposed in PLT 3 controls the carbides and makes the prior-austenite finer in an attempt to achieve both strength and cold coilability.

Furthermore, the high strength steels for spring proposed in PLTs 4 to 7 control the retained austenite and carbides and make the prior-austenite finer in an attempt to achieve both strength and cold coilability. In particular, they suppress the formation of coarse oxides and carbides which form starting points of fracture and control the retained austenite in addition to the state of precipitation of carbides so as to suppress the deterioration of the fatigue properties and workability of high strength steel wire for spring.

CITATION LIST

Patent Literature

PLT 1: Japanese Patent Publication (A) No. 2000-169937
PLT 2: Japanese Patent Publication (A) No. 2003-3241
PLT 3: Japanese Patent Publication (A) No. 2002-180198
PLT 4: Japanese Patent Publication (A) No. 2002-235151
PLT 5: Japanese Patent Publication (A) No. 2006-183137
PLT 6: Japanese Patent Publication (A) No. 2006-342400
PLT 7: International Publication WO2007/114491

SUMMARY OF INVENTION

Technical Problem

However, in recent years, to improve the durability of high strength spring, increase of the temperature of nitridation has been studied. For this reason, high strength steel wire for spring is required to be further improved in temper softening resistance.

The high strength steel wire for spring proposed in PLTs 4 to 7 were improved in both strength and cold coilability, but achievement of both temper softening resistance and cold coilability has not been sufficiently studied.

The present invention has as its object the provision of high strength steel wire for spring excellent in cold coilability and maintaining tensile strength and hardness even after being held at 500° C. for 1 hour, that is, having excellent temper softening resistance.

Solution to Problem

The inventors obtained the discovery that by strictly controlling the contents of C, Si, Mn, Cr, and V to suppress the formation of spheroidal carbides and by actively using the retained austenite, the strength and cold coilability of steel wire for spring are improved over the past.

Furthermore, the inventors studied the temper softening resistance of high strength steel wire for spring when the high strength steel wire for spring is tempered at a higher temperature than the past.

As a result, they obtained the discovery that to improve the temper softening resistance of high strength steel wire for spring, it is necessary to combinedly add No and W and control the total of contents of No and W (Mo+W).

The present invention was made based on these discoveries. The gist of the invention is as follows:

(1) High strength steel wire for spring containing, by mass %,

C: 0.67% to less than 0.75%,
Si: 2.0 to 2.5%,
Mn: 0.5 to 1.2%,
Cr: 0.8 to 1.3%,
V: 0.03 to 0.20%,
Mo: 0.05 to 0.25%,
W: 0.05 to 0.30%, and
N: 0.003 to 0.007%, having a total of contents of Mn and V of 0.70%≤Mn+V≤1.27% and a total of contents of Mo and W of 0.13%≤Mo+W≤0.35%, limiting P: 0.025% or less, S: 0.025% or less, and Al: 0.003% or less, and having a balance of iron and unavoidable impurities, having a microstructure comprised of, by volume percent, over 6% to 15% of retained austenite and tempered martensite, having a prior-austenite grain size number of 10 or more, having a density of presence of spheroidal carbides with a circle equivalent diameter of 0.2 to 0.5 μm of 0.6 particles/$\mu m^2$ or less, having a density of presence of spheroidal carbides with a circle equivalent diameter of over 0.5 μm of 0.01 particles/$\mu m^2$ or less, and having a tensile strength of 2100 to 2350 MPa.

(2) High strength steel wire for spring as set forth in (1), wherein the yield strength is 1470 to 1980 MPa.

(3) High strength steel wire for spring as set forth in (1) or (2), wherein a Vicker's hardness after heat treatment holding the wire at 500° C. for 1 hour is 570 or more.

Advantageous Effects of Invention

According to the present invention, it is possible to provide high strength steel wire for spring excellent in cold coilability and maintaining tensile strength and hardness even after high temperature heating, that is, excellent in temper softening resistance, and possible to obtain a high strength spring excellent in durability.

DESCRIPTION OF EMBODIMENTS

Figure 1:
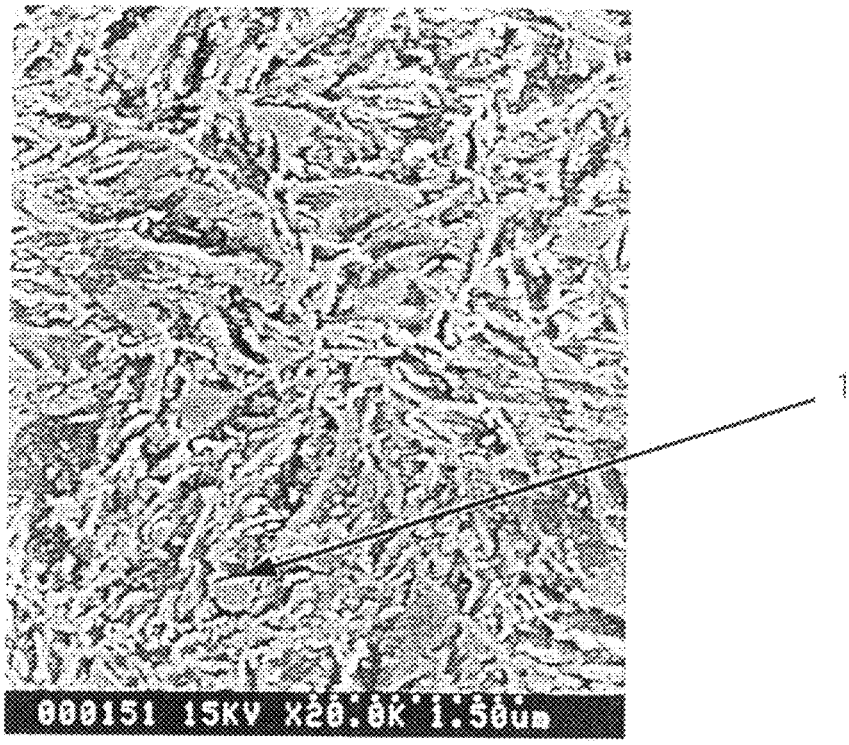
FIG. 1 is a view showing one example of spheroidal carbides of high strength steel wire for spring of the present invention.

The present invention in particular provides high strength steel wire for spring excellent in cold coilability and temper softening resistance. The high strength spring produced using the steel wire of the present invention as a raw material is excellent in fatigue properties and settling properties.

The high strength steel wire for spring of the present invention makes the amounts of addition of C and V more optimum ranges than the past for further suppressing formation of coarse spheroidal carbides which act as starting points of fracture.

Further, to further raise the strength and secure cold coilability compared with the past, the amounts of addition of Mn and V are optimized and the improvement in ductility due to the transformation-induced plasticity of retained austenite is utilized.

Furthermore, to enable hardness to be maintained even after performing heat treatment at a higher temperature than the past, the amounts of addition of Mo and W are optimized and the temper softening resistance is improved.

First, the chemical composition of the high strength steel wire for spring of the present invention will be explained. Here, the % of the chemical composition means mass %.

C: 0.67% to less than 0.75%

C is an important element which has a large effect on the strength of the steel material and also contributes to the formation of retained austenite. In the present invention, to obtain sufficient strength, the amount of C is made 0.67% or more. Preferably, the amount is over 0.70%.

On the other hand, if the amount of C becomes 0.75% or more, hyper-eutectic occurs, a large amount of coarse cementite precipitates, and the toughness remarkably falls. Further, if the amount of C is excessive, coarse spheroidal carbides are generated and the coilability is impaired. Therefore, the amount of C is made less than 0.75%.

Si: 2.0 to 2.5%

Si is an important element improving the temper softening resistance of the steel and the settling properties of the spring. At least 2.0% must be added. Further, Si is also effective for making the cementite spheroidal and finer. For suppressing the formation of coarse spheroidal carbides, 2.1% or more of Si is preferably added. To raise the internal hardness after performing nitridation or other treatment for causing the surface layer to harden, it is preferable to add 2.2% or more of Si. On the other hand, if excessively adding Si, the steel wire hardens and becomes brittle, so the upper limit of the amount of Si is made 2.5%.

Mn: 0.5 to 1.2%

Mn is an important element for improving the quenchability and stably securing the amount of retained austenite. In the present invention, to raise the tensile strength of the steel wire and secure the retained austenite, Mn is added in an amount of 0.5% or more. On the other hand, if excessively adding Mn, the retained austenite increases, strain induced martensite is formed at the time of working, and the cold coilability is impaired. To prevent embrittlement due to the addition of excessive Mn, the upper limit of the amount of Mn is made 1.2% or less.

Further, to raise the tensile strength, the amount of Mn is preferably made 0.65% or more. On the other hand, when improving the cold coilability, the amount of Mn is preferably made 1.1% or less. The more preferable upper limit of the amount of Mn is 0.90%.

V: 0.03 to 0.20%

V is an element forming nitrides, carbides, and carbonitrides. Fine nitrides, carbides, and carbonitrides of V with a circle equivalent diameter of less than 0.2 μm are effective for increasing the fineness of prior-austenite and can also be utilized for hardening the surface layer by nitridation.

To obtain these effects, it is necessary to add V in an amount of 0.03% or more. To secure the amount of retained austenite, it is preferable to add V in an amount of 0.05% or more.

On the other hand, if adding over 0.20% of V, coarse spheroidal carbides are formed and the cold coilability and spring fatigue properties are impaired. Therefore, the upper limit of the amount of V is made 0.2%. Further, due to addition of V, before wire drawing, supercooled structures, which cause cracking and breakage at the time of drawing, are easily formed. For this reason, the upper limit of the amount of V is preferably made 0.15%.

Further, V, like Mn, is an element which greatly affects the formation of retained austenite, so the amount of V has to be precisely controlled together with the amount of Mn.

$0.70\% \leq Mn+V \leq 1.27\%$

Mn and V are elements for improving the hardenability. The effect on the formation of retained austenite is also large.

For this reason, in the present invention, the total of the contents of Mn and V (Mn+V) is made 0.7 to 1.27%.

To secure an amount of retained austenite of a volume percent of over 6%, it is necessary to make the lower limit value of (Mn+V) 0.7%. As a result, the ductility is improved by the transformation-induced plasticity, and the cold coilability can be secured.

On the other hand, to make the retained austenite a volume percent of 15% or less, the upper limit value of (Mn+V) has to be made 1.27%. Due to this, the formation of strain induced martensite due to the strike defects at the time of cold coiling is suppressed and local embrittlement can be prevented. To improve the yield strength, the upper limit of the (Mn+V) is preferably made 1.25%.

Mo: 0.05 to 0.25%

Mo is an element improving the hardenability. Further, it is extremely effective for improving the temper softening resistance. In the present invention, in particular, to improve the temper softening resistance, 0.05% or more of Mo is added. Further, Mo is an element forming Mo-based carbides in the steel. The temperature at which Mo-based carbides precipitate is lower than with carbides of V etc. For this reason, addition of a suitable amount of Mo is also effective for suppressing coarsening of carbides. Therefore, 0.10% or more of Mo is preferably added.

On the other hand, if the amount of addition of Mo is over 0.25%, supercooled structures easily form due to hot rolling, patenting at the time of wire drawing, etc. Therefore, to suppress the formation of supercooled structures causing cracking or breakage at the time of wire drawing, the upper limit of the amount of Mo is made 0.25%. Further, if the amount of Mo is great, the time until pearlite transformation ends becomes longer in patenting, so the amount of Mo is preferably made 0.15% or less.

W: 0.05 to 0.30%

W, in the same way as Mo, is an element effective for improvement of the hardenability and temper softening resistance and an element which precipitates as a carbide in steel. In the present invention, in particular to raise the temper softening resistance, 0.05% or more of W is added.

On the other hand, it is necessary to make the amount of W 0.30% or less so as to suppress the formation of supercooled structures, when W is excessively added, causing breakage at the time of wire drawing. Furthermore, if considering the easy heat treatment etc., the amount of W is preferably 0.10 to 0.20%, more preferably 0.13 to 0.18%.

$0.13 \leq Mo+W \leq 0.35\%$

Mo and W are elements effective for improvement of the temper softening resistance. In the present invention, the both of Mo and W are added together. As a result, the growth of the carbides is more suppressed and the temper softening resistance can be much more improved in the case of adding both of Mo and W than in the case of adding Mo and W respectively. In particular, to raise the temper softening resistance when heating to 500° C., it is necessary to make the (Mo+W) 0.13% or more. To further raise the temper softening resistance, (Mo+W) is preferably made 0.15% or more.

On the other hand, if (Mo+W) exceeds 0.35%, martensite, bainite and the like, that are so-called supercooled structures, are formed when hot rolling and patenting before the wire drawing. Therefore, to suppress the formation of supercooled structures causing cracking or breakage at the time of drawing, the upper limit of (Mo+W) is made 0.35%. Further, from the viewpoint of reducing the number of spheroidal carbides, mentioned later, as much as possible, improving the temper softening resistance more, and preventing deterioration of the cold coilability more effectively, the upper limit of (Mo+W) is preferably made 0.24%.

Cr: 0.8 to 1.3%

Cr is an element effective for improvement of the hardenability and temper softening resistance. In the present invention, 0.8% or more of Cr is added. When performing nitridation, it is possible to make the hardened layer formed by the nitridation deeper by the addition of Cr. Therefore, when hardening by nitridation and increasing softening resistance at the nitridation temperature, it is preferable to add over 1.0% of Cr.

On the other hand, if the amount of Cr is excessive, not only the manufacturing cost becomes higher, the dissolution of the carbides is inhibited, the amount of undissolved carbides becomes greater, and the coilability is obstructed, so the upper limit of the amount of C is made 1.3%. Further, if the amount of C is large, to suppress the formation of coarse cementite, it is preferable to suppress the amount of Cr to 1.2% or less. Furthermore, to achieve both strength and coilability, the upper limit of the amount of C is preferably made 1.1%.

N: 0.003 to 0.007%

N, in the present invention, is an element forming nitrides with the V contained in the steel. To utilize the fine nitrides and make the prior-austenite finer, in the present invention, 0.003% or more of N is contained.

On the other hand, if the amount of N is excessive, the nitrides become coarser and the cold coilability and fatigue properties deteriorate. Therefore, the upper limit of the amount of N is made 0.007%. Further, if considering the easy heat treatment etc., the upper limit of the amount of N is preferably 0.005%.

P: 0.025% or less

P is an impurity. P causes the steel to harden, causes segregation, and causes embrittlement, so the amount of P is limited to 0.025% or less. Further, the P segregated at the prior-austenite grain boundaries causes a decline in the toughness, and delayed fracture resistance, etc., so the amount of P is preferably limited to 0.015% or less. Furthermore, when the tensile strength of steel wire exceeds 2150 MPa, the amount of P is preferably limited to less than 0.010%.

S: 0.025% or less

S is also an impurity and causes the steel to become brittle if present in the steel, so the amount of S is limited to 0.025% or less. To suppress the effect of S, the addition of Mn is effective. However, MnS forms inclusions. In particular, in high strength steel, MnS sometimes becomes the starting point of fracture. Therefore, to suppress the occurrence of fractures, the amount of S is preferably limited to 0.015% or less. Furthermore, when the tensile strength of the steel wire exceeds 2150 MPa, it is preferable to limit the amount of S to less than 0.010%.

Al: 0.003% or less

Al is a deoxidizing element and affects the formation of oxides. If forming hard oxides, the fatigue durability deteriorates. In particular, in high strength spring, if excessively adding Al, the fatigue strength becomes diverse and the stability is impaired. In the high strength steel wire for spring of the present invention, if the amount of Al exceeds 0.003%, the rate of occurrence of fractures due to inclusions increases, so the amount of Al is limited to 0.003% or less.

Next, the microstructure of the high strength steel wire for spring of the present invention will be explained. The microstructure of the high strength steel wire for spring of the present invention is comprised of, by volume percent, more than 6% to 15% of retained austenite and tempered martensite.

Prior-austenite grain size number: #10 or more

The high strength steel wire for spring of the present invention has tempered martensite as its main microstructure. The prior-austenite grain size affects properties of the high strength steel wire for spring greatly. That is, if making the grain size of the prior-austenite finer, the fatigue properties and coilability are improved due to the effect of the increased grain fineness.

In the present invention, to obtain sufficient fatigue properties and coilability, the prior-austenite grain size number is made #10 or more. Increased fineness of the prior-austenite is particularly effective for improvement of the properties of the high strength steel wire for spring. The prior-austenite grain size number is preferably made #11, more preferably #12 or more.

To make the grain size of the prior-austenite finer, lowering the heating temperature of the quenching or shortening the heating time is effective. However, if excessively lowering the heating temperature of the quenching and shortening the heating time, coarse spheroidal carbides may remain. For this reason, the preferable upper limit of the prior-austenite grain size number is #13.5. Note that, the prior-austenite grain size number is measured based on JIS G 0551.

Retained austenite: over 6% to 15% (vol %)

Retained austenite is effective for improvement of the cold coilability. In the present invention, to secure the cold coilability, the volume percent of the retained austenite is made over 6%.

On the other hand, if the retained austenite has a volume percent of over 15%, the martensite formed by strain induced transformation causes the cold coilability to decline. Therefore, the volume percent of the retained austenite is made 15% or less.

The volume percent of the retained austenite can be found by the X-ray diffraction method or the magnetic measurement method. Among these, the magnetic measurement method is a preferable method of measurement able to simply measure the volume percent of the retained austenite.

Further, retained austenite is softer than tempered martensite, so causes a decline in the yield strength and, further, improves the ductility due to transformation-induced plasticity, so remarkably contributes to improvement of the cold coilability.

On the other hand, retained austenite often remains at the segregated portions, prior-austenite grain boundaries, and near regions sandwiched between subgrains, so martensite formed by work-induced transformation (strain induced martensite) forms the starting points of fracture.

Further, if the retained austenite increases, the tempered martensite relatively decreases. The microstructure is comprised of retained austenite and tempered martensite.

For this reason, in the past, the decline in strength and cold coilability due to the retained austenite became a problem. However, in the steel wire for spring of the present invention where a high strength of over 2000 MPa is demanded, the amounts of addition of C, Si, Mn, Cr, etc. become greater, so for improvement of the cold coilability, utilization of the transformation-induced plasticity of the retained austenite is extremely effective.

Further, recently, due to the high precision spring forming technology, it has become possible to suppress deterioration of the coiling properties to a certain extent even if local high hardness portions are formed due to strain induced martensite formed at the time of spring formation.

Spheroidal Carbides

The high strength steel wire for spring of the present invention, to increase the strength, is added C and the other so-called alloy elements which are Mn, V, Cr, Mo, W and the like.

When C and, in particular, V, Cr, and other alloy elements forming nitrides, carbides, and carbonitrides, are added in large amounts, spheroidal cementite carbides and alloy carbides easily remain in the steel.

The spheroidal cementite carbides and alloy carbides are undissolved carbides which failed to form solid solutions in the steel at the time of heating in the hot rolling. Note that, in the present invention, the spheroidal alloy carbides and spheroidal cementite carbides are referred to all together as "spheroidal carbides".

Spheroidal carbides can be observed by a scan type electron microscope (SEM) after polishing a sample taken from high strength steel wire for spring and etching it by picral or electrolytic etching, etc. Further, they may be observed by the replica method of a transmission type electron microscope (TEM).

FIG. 1 shows an example of the structure of a sample after electrolytic etching observed by an SEM.

In the photograph of the microstructure shown in FIG. 1, two types, that is, acicular structures of the matrix and spheroidal structures, are observed in the steel. Of these, the acicular structures are tempered martensite formed by quenching and tempering.

On the other hand, the spheroidal structures are carbides (spheroidal carbides) 1 which do not form a solid solution in the steel by the heating of the hot rolling and are spheroidized by oil temper treatment or induction heating treatment for quenching and tempering.

In the present invention, spheroidal carbides affect the properties of the high strength steel wire for spring, so the size and density are controlled as follows. In the present invention, compared with the prior art, the fine spheroidal carbides are further defined and both a higher performance and workability are attempted.

Spheroidal carbides of a circle equivalent diameter of less than 0.2 μm are effective for securing the strength and temper softening resistance of the steel. On the other hand, spheroidal carbides of a circle equivalent diameter of 0.2 μm or more do not contribute to improvement of the strength and temper softening resistance, but cause deterioration of the cold coilability. For this reason, in the present invention, the density of presence of spheroidal carbides of a circle equivalent diameter of 0.2 μm or more is controlled.

Furthermore, spheroidal carbides of a circle equivalent diameter of over 0.5 μm cause remarkable deterioration of the properties. Therefore, compared with spheroidal carbides of a circle equivalent diameter of 0.2 to 0.5 μm, the density of presence of spheroidal carbides of a circle equivalent diameter of over 0.5 μm has to be further limited.

Density of presence of spheroidal carbides of a circle equivalent diameter of 0.2 to 0.5 μm: 0.06 particles/$\mu m^2$ or less The high strength steel wire for spring of the present invention has a high strength, so spheroidal carbides of a circle equivalent diameter of 0.2 to 0.5 μm are also harmful to the cold coilability, so the fewer the better. For this reason, the density of presence of the spheroidal carbides of an average grain size by a circle equivalent diameter of 0.2 to 0.5 μm was limited to 0.06 particles/$\mu m^2$ or less.

Density of presence of spheroidal carbides of a circle equivalent diameter of over 0.5 μm: 0.01 particles/$\mu m^2$ or less The spheroidal carbides of a circle equivalent diameter of over 0.5 μm, compared with spheroidal carbides of a circle equivalent diameter of 0.2 to 0.5 μm, cause the mechanical properties and workability to remarkably decline, so are preferably fewer in number. For this reason, the density of presence of spheroidal carbides of a circle equivalent diameter of over 0.5 μm is limited to 0.01 particles/$\mu m^2$ or less.

Here, the method of measurement of the circle equivalent diameter and density of presence of the spheroidal carbides will be explained. A sample taken from high strength steel wire for spring is polished and electrolytically etched. Note that, for the observed location, a location near the center of the radius of the heat treated wire material (steel wire), the so-called "1/2R location", is randomly observed so as to eliminate decarburization, center segregation, and other special conditions. Note that, the measured area is made 300 $\mu m^2$ or more.

The electrolytic etching is performed in an electrolytic solution (mixed solution of acetyl acetone 10 mass %, tetramethyl ammonium chloride 1 mass %, and balance methyl alcohol) using the sample as an anode, platinum as a cathode, and a low electric potential current generating apparatus to cause the sample surface to corrode by an electrolytic action.

The electric potential is made a potential of −50 to −200 mV vs SCE in range suitable for each sample. For the steel wire of the present invention, it is preferably made a constant −100 mV vs SCE.

The amount of running current can be found by the total surface area of the sample×0.133 [c/$cm^2$]. Note that, when burying the sample in a resin, not only the area of the polished surface, but also the sample surface in the resin is added for calculation of the total surface area of the sample.

After holding for 10 seconds after starting to run a current, the current is stopped and the surface is washed. After that, the sample is observed by SEM and the structure of the spheroidal carbides is photographed. The portions of the microstructure which appear relatively white under an SEM and have a ratio of the long axis and short axis (aspect ratio) of 2 or less are spheroidal carbides. The magnification under the SEM is 1000× or more, preferably 5000 to 20000×.

The thus captured microstructural photograph by SEM is image processed, the circle equivalent diameters are calculated, and the density of presence of spheroidal carbides with a circle equivalent diameter of 0.2 to 0.5 μm and over 0.5 μm found in the measurement field is measured.

Next, the mechanical properties of the high strength steel wire for spring of the present invention will be explained.

To reduce the size and lighten the weight of the spring, it is effective to raise the strength of the raw material for steel wire for spring. Further, a spring using such a high strength steel wire for spring as a raw material is required to have an excellent fatigue strength.

The high strength spring of the present invention is produced by bending the material steel wire to a desired shape, then nitriding, shot peening, or otherwise treating the surface to harden it.

In nitridation, the spring is heated to 500° C. or more, so the spring sometimes softens compared with the raw material for steel wire. Therefore, to make the spring higher strength and raise the fatigue properties, it is necessary to secure the tensile strength of the raw material for steel wire.

Further, to work the high strength steel wire for spring into the desired shape of a spring, cold coilability is required, so it is necessary to set an upper limit of the tensile strength.

Tensile strength: 2100 to 2350 MPa

If the tensile strength of the steel wire for spring becomes higher, it is possible to raise the fatigue properties and settling properties of the spring treated at the surface by nitridation etc.

In the present invention, to raise the fatigue properties and settling properties of the spring, the tensile strength of the steel wire for spring is made 2100 MPa or more. Further, the higher the tensile strength of the steel wire for spring, the better the fatigue properties of the spring, so the tensile strength of the steel wire for spring is preferably made 2200 MPa or more, more preferably 2250 MPa or more.

On the other hand, if the tensile strength of the steel wire for spring is too high, the cold coilability falls, so the tensile strength is made 2350 MPa or less.

The cold coilability can be more accurately evaluated by a later explained notched bending test. Even when the tensile strength of the steel wire for spring is excessively high and the steel wire for spring breaks at the time of cold coiling, if the bending properties of the steel wire for spring are excellent, cold coiling is possible. This is due to the fact that what acts on the steel wire at the time of cold coiling is mainly bending stress. The notched bending angle is preferably 28 degrees or more. 30 degrees or more is more preferable.

Yield strength: 1470 to 1980 MPa

To secure the strength and settling resistance of the spring, which elastically deforms due to repeated stress, it is preferable to raise the yield strength. Note that, in the present invention, the "yield strength" is the top yield point on a stress-strain curve when the yield point is clear and is the 0.2% proof strength when the yield point is not clear.

To raise the yield strength of the spring, it is preferable to raise the yield strength of steel wire for spring as a material steel. On the other hand, if the yield strength of the steel wire for spring becomes excessively high, the cold coilability is sometimes impaired.

Therefore, the yield strength of the steel wire for spring is preferably made 1470 MPa or more so as to secure the strength and settling resistance of the spring.

On the other hand, if the yield strength exceeds 1980 MPa, the cold coilability is sometimes impaired, so the yield strength is preferably made 1980 MPa or less.

Further, to raise the yield strength of the steel wire for spring, it is preferable to lower the volume percent of the retained austenite.

Vicker's hardness after heat treatment holding wire at 500° C. for 1 hour: 570 or more The high strength spring, at the time of nitridation, is for example heated to 500° C. or so. In the past, if the heating temperature became 500° C., it was difficult to suppress softening of the steel wire.

The high strength steel wire for spring of the present invention is excellent in temper softening resistance. It is possible to secure the fatigue properties and settling properties of the spring after heating at 500° C.

Note that, in the present invention, the indicator of the temper softening resistance is made the Vicker's hardness after heat treatment holding the wire at 500° C. for 1 hour. The Vicker's hardness is preferably measured at a position of a depth of 500 μm from the surface so that the temperature of the surface layer of the steel wire does not become higher than the inside at the time of quenching.

To secure the fatigue properties and settling properties of the spring, the Vicker's hardness after heat treatment holding the wire at 500° C. for 1 hour may be made 570 or more, more preferably is made 575 or more.

On the other hand, the upper limit of the Vicker's hardness after heat treatment holding the wire at 500° C. for 1 hour is not particularly limited, but the Vicker's hardness before the heat treatment is never exceeded, so usually the upper limit is 783.

Further, when producing a high strength spring using the high strength steel wire for spring of the present invention as a material, the surface hardens due to the shot peening and nitridation.

On the other hand, the hardness of the inside, that is, the Vicker's hardness (internal hardness) at a position of a depth of 500 μm from the surface of the high strength spring is affected by the heating at the time of nitridation. Therefore, when actually producing a spring, the internal hardness fluctuates due to the temperature of the nitridation.

However, in the case of a high strength spring, to avoid a fall in the internal hardness, the general practice is to control the temperature of the nitridation to a low temperature. For this reason, the internal hardness of the spring is considered to become higher than the Vicker's hardness after heat treating the material steel wire by holding it at 500° C. for 1 hour.

Therefore, the high strength spring using the high strength steel wire for spring of the present invention as a material has an internal hardness of a Vicker's hardness of 570 or more and has extremely excellent fatigue properties and settling properties.

Note that, when producing a high strength spring using the high strength steel wire for spring of the present invention as a raw material, cold coiling and nitridation are performed. For this reason, the retained austenite at a position of a depth of 500 μm from the surface of the high strength spring is reduced somewhat compared with the raw material. However, the chemical composition, spheroidal carbides, and prior-austenite crystal grain size are believed to be little influenced by the cold coiling and nitridation.

Therefore, the chemical composition, spheroidal carbides, and prior-austenite crystal grain size of the high strength spring using the high strength steel wire for spring of the present invention as a raw material are similar to chemical composition, spheroidal carbides, and prior-austenite crystal grain size of the high strength steel wire for spring of the present invention.

For example, when using a spring produced by using the high strength steel wire for spring of the present invention as a valve spring for an internal combustion engine, it is possible to reduce the wire diameter and lower the valve operation friction while maintaining durability compared with conventional materials.

Further, it is possible to increase the valve lift and raise the speed and, in addition, reduce the total length or outside diameter compared with the past and contribute to the internal combustion engine.

Next, the method of production of the high strength steel wire for spring of the present invention will be explained.

The high strength steel wire for spring of the present invention is produced by pre-heating and hot rolling a steel billet, patenting it, shaving it, and further annealing it for softening the hardened layer, then drawing it and quenching and tempering it.

The patenting treatment is heat treatment for making the structure of the steel wire after hot rolling ferrite and pearlite. It is performed for softening the steel wire before drawing.

After drawing, oil temper treatment or induction heating treatment or other quenching and tempering are performed to adjust the structure and properties of the steel wire.

When producing the high strength steel wire for spring of the present invention, it is necessary to prevent coarsening of the spheroidal carbides. In general, when producing a steel billet, the cooling speed is slow, so the carbides easily become coarser. For this reason, in the present invention, the heating temperature of the hot rolling is particularly important.

In the hot rolling, the steel slab is heated to 1100° C. or more and a solid solution of the coarse carbides is promoted. To prevent the formation of coarse spheroidal carbides, it is necessary to make the coarse carbides formed in the steel billet form a solid solution in the steel. It is preferable to raise the heating temperature. For this reason, the preferable heating temperature of the hot rolling is 1150° C. or more, while the more preferable heating temperature is made 1200° C. or more.

After being taken out from the heating furnace, the temperature falls and the precipitates grow. For this reason, it is preferable to finish the hot rolling within 5 minutes after taking the wire out from the heating furnace.

After hot rolling, the steel wire is patented. The heating temperature of the patenting, for promoting the formation of a solid solution of the carbides, is preferably a high temperature of 930° C. or more, more preferably 950° C. or more.

When the drawing process is omitted due to the required wire material size or precision, sometimes the patenting process preceding the drawing process is also omitted. In this case, it is important to promote the formation of a solid solution of the carbides by the heating before the quenching.

The quenching after drawing is performed after heating the steel wire to a temperature of the $A_3$ point or more. To promote the formation of a solid solution of the carbides, the heating temperature of the quenching is preferably raised.

In the heating before quenching, to suppress the growth of the carbides, the heating speed is preferably made 10° C./s or more and the holding time is made 5 minutes or less. Further, to suppress the growth of austenite grains, the holding time is preferably made short.

In the quenching, cooling speed is made preferably 50° C./s or more and cooling is performed down to 100° C. or less so as to promote martensite transformation.

The temperature of a quenching medium is preferably low. 100° C. or less is preferable, 80° C. or less is more preferable. On the other hand, the lower limit of the temperature of a quenching medium is preferably 40° C. so as to precisely control the amount of retained austenite.

The quenching medium may be an oil, a water-soluble quenching agent, water, etc. It is not particularly limited so long as quenching is possible by such quenching mediums.

Further, the cooling time may be made shorter like with oil temper treatment or induction heating treatment. To reduce the retained austenite to an extremely low level, avoiding an excessively long holding time at a low temperature is preferable. The temperature of quenching medium should not be 30° C. or less. The quenching is preferably ended within 5 minutes.

After quenching, tempering is performed. The tempering is preferably performed, to suppress growth of carbides, by a heating speed of 10° C./s or more and a holding time of 15 minutes or less.

The steel wire for spring is shaped by cold coiling to the desired spring shape, then is treated by stress-relieving annealing and is further nitrided and shot peened to produce a spring.

The cold coiled steel wire is reheated by stress-relief annealing or nitridation. At that time, in conventional high strength steel wire for spring, the inside softens, so the performance as a spring falls.

However, in the high strength steel wire for spring of the present invention, even if nitriding the steel wire at a high temperature of 500° C. or so, the steel wire after the nitridation holds sufficient hardness.

That is, if using the high strength steel wire for spring of the present invention as a raw material, it is possible to make the Vicker's hardness at a depth of 500 μm from the surface layer of the high strength spring HV570 or more. Note that, the Vicker's hardness at a depth of 500 μm from the surface layer of the spring is measured so as to evaluate the Vicker's hardness of the raw material free of the effects of the hardening by the nitridation and shot peening.

EXAMPLES

Next, the present invention will be further exampled by examples, but the conditions of the examples are one illustration of the conditions for confirming the workability and advantageous effects of the present invention. The present invention is not limited to this one illustration of the conditions. The present invention can employ various conditions so long as not deviating from the gist of the present invention and so long as achieving the object of the present invention.

Each steel having the chemical compositions shown in Tables 1 and 2 was melted and cast to produce a steel bloom. Note that the values of the chemical compositions are values found by rounding off the lower order digits.

Each sample was refined in a 250 ton converter and continuously cast to obtain a billet or was smelted in a 2 ton vacuum smelting furnace and cast, then the cast piece heated to 1200° C. and rolled to obtain a billet.

The obtained steel billet was hot rolled to obtain a 8 mm diameter rolled wire material. This was drawn to obtain a 4 mm diameter drawn wire material. At that time, to obtain the material having the microstructure easier to draw, the material was patented before drawing. For the heating temperature for the patenting, the heating temperature is preferably 900° C. or more so that the carbides sufficiently form a solid solution. The invention examples were heated at 930 to 950° C. for patenting.

To adjust the tensile strength of the patented and drawn steel wire, quenching and tempering were performed to thereby produce the steel wire for spring.

Note that, samples which broke during the drawing process (Nos. 30, 32, and 36) were not treated by quenching and tempering.

TABLE 1

| | Chemical compositions (mass %) | | | | | | | | | | | | | |
|---|---|---|---|---|---|---|---|---|---|---|---|---|---|---|
| No. | C | Si | Mn | P | S | Cr | V | Mo | W | Al | N | Mn + V | Mo + W | Remarks |
| 1 | 0.73 | 2.08 | 0.67 | 0.008 | 0.005 | 0.91 | 0.10 | 0.08 | 0.11 | 0.002 | 0.004 | 0.77 | 0.20 | Inv. ex. |
| 2 | 0.69 | 2.00 | 0.64 | 0.003 | 0.005 | 0.94 | 0.07 | 0.14 | 0.12 | 0.002 | 0.003 | 0.71 | 0.26 | Inv. ex. |
| 3 | 0.74 | 2.23 | 0.67 | 0.005 | 0.006 | 1.16 | 0.10 | 0.14 | 0.06 | 0.002 | 0.003 | 0.77 | 0.20 | Inv. ex. |
| 4 | 0.69 | 2.42 | 0.72 | 0.005 | 0.006 | 1.08 | 0.20 | 0.13 | 0.06 | 0.001 | 0.004 | 0.91 | 0.19 | Inv. ex. |
| 5 | 0.68 | 2.42 | 0.79 | 0.009 | 0.005 | 1.19 | 0.11 | 0.13 | 0.09 | 0.003 | 0.003 | 0.90 | 0.22 | Inv. ex. |
| 6 | 0.73 | 2.40 | 0.63 | 0.003 | 0.004 | 1.08 | 0.18 | 0.11 | 0.16 | 0.001 | 0.005 | 0.81 | 0.26 | Inv. ex. |
| 7 | 0.69 | 2.17 | 0.62 | 0.003 | 0.005 | 1.13 | 0.06 | 0.12 | 0.15 | 0.001 | 0.005 | 0.68 | 0.27 | Inv. ex. |
| 8 | 0.68 | 2.49 | 0.73 | 0.006 | 0.006 | 1.05 | 0.10 | 0.13 | 0.08 | 0.003 | 0.005 | 0.83 | 0.20 | Inv. ex. |
| 9 | 0.74 | 2.10 | 0.74 | 0.005 | 0.007 | 1.03 | 0.14 | 0.12 | 0.15 | 0.001 | 0.003 | 0.88 | 0.26 | Inv. ex. |
| 10 | 0.70 | 2.01 | 0.63 | 0.008 | 0.003 | 1.02 | 0.06 | 0.08 | 0.18 | 0.002 | 0.005 | 0.69 | 0.26 | Inv. ex. |
| 11 | 0.67 | 2.20 | 0.64 | 0.008 | 0.008 | 0.95 | 0.10 | 0.15 | 0.12 | 0.002 | 0.004 | 0.74 | 0.27 | Inv. ex. |
| 12 | 0.74 | 2.25 | 0.70 | 0.006 | 0.004 | 1.12 | 0.05 | 0.10 | 0.09 | 0.001 | 0.003 | 0.76 | 0.19 | Inv. ex. |
| 13 | 0.71 | 2.05 | 0.72 | 0.005 | 0.005 | 1.16 | 0.10 | 0.08 | 0.05 | 0.001 | 0.003 | 0.82 | 0.13 | Inv. ex. |
| 14 | 0.68 | 2.46 | 0.78 | 0.009 | 0.006 | 1.17 | 0.19 | 0.06 | 0.24 | 0.002 | 0.004 | 0.96 | 0.30 | Inv. ex. |
| 15 | 0.72 | 2.25 | 0.90 | 0.009 | 0.004 | 1.13 | 0.19 | 0.14 | 0.09 | 0.002 | 0.006 | 1.09 | 0.22 | Inv. ex. |
| 16 | 0.72 | 2.10 | 0.72 | 0.007 | 0.004 | 1.19 | 0.05 | 0.06 | 0.29 | 0.002 | 0.005 | 0.78 | 0.35 | Inv. ex. |
| 17 | 0.67 | 2.06 | 0.75 | 0.003 | 0.005 | 1.09 | 0.15 | 0.13 | 0.10 | 0.002 | 0.004 | 0.90 | 0.23 | Inv. ex. |
| 18 | 0.69 | 2.42 | 0.73 | 0.005 | 0.007 | 1.17 | 0.17 | 0.07 | 0.14 | 0.002 | 0.005 | 0.90 | 0.21 | Inv. ex. |

TABLE 2

| | Chemical compositions (mass %) | | | | | | | | | | | | | |
|---|---|---|---|---|---|---|---|---|---|---|---|---|---|---|
| No. | C | Si | Mn | P | S | Cr | V | Mo | W | Al | N | Mn + V | Mo + W | Remarks |
| 19 | 0.64 | 2.12 | 0.67 | 0.004 | 0.007 | 1.02 | 0.08 | 0.09 | 0.11 | 0.001 | 0.005 | 0.75 | 0.20 | Comp. ex. |
| 20 | 0.79 | 2.14 | 0.82 | 0.008 | 0.006 | 1.00 | 0.15 | 0.09 | 0.18 | 0.002 | 0.005 | 0.96 | 0.27 | Comp. ex. |
| 21 | 0.70 | 1.75 | 0.96 | 0.006 | 0.007 | 1.00 | 0.15 | 0.06 | 0.19 | 0.001 | 0.003 | 1.11 | 0.25 | Comp. ex. |
| 22 | 0.68 | 2.52 | 0.78 | 0.007 | 0.005 | 1.03 | 0.14 | 0.06 | 0.15 | 0.001 | 0.006 | 0.93 | 0.21 | Comp. ex. |
| 23 | 0.70 | 2.39 | 0.42 | 0.007 | 0.007 | 1.14 | 0.06 | 0.11 | 0.17 | 0.001 | 0.005 | 0.48 | 0.28 | Comp. ex. |
| 24 | 0.74 | 2.15 | 1.21 | 0.006 | 0.006 | 0.97 | 0.05 | 0.13 | 0.20 | 0.001 | 0.003 | 1.26 | 0.33 | Comp. ex. |
| 25 | 0.72 | 2.09 | 0.78 | 0.008 | 0.007 | 0.75 | 0.06 | 0.09 | 0.08 | 0.003 | 0.006 | 0.84 | 0.17 | Comp. ex. |
| 26 | 0.74 | 2.09 | 0.86 | 0.005 | 0.007 | 1.95 | 0.11 | 0.29 | 0.06 | 0.001 | 0.007 | 0.97 | 0.35 | Comp. ex. |
| 27 | 0.70 | 2.12 | 0.71 | 0.008 | 0.003 | 1.15 | 0.01 | 0.12 | 0.13 | 0.001 | 0.004 | 0.72 | 0.25 | Comp. ex. |
| 28 | 0.74 | 2.05 | 0.98 | 0.008 | 0.008 | 1.17 | 0.25 | 0.05 | 0.12 | 0.002 | 0.005 | 1.23 | 0.17 | Comp. ex. |
| 29 | 0.69 | 2.33 | 0.77 | 0.008 | 0.009 | 0.91 | 0.14 | 0.01 | 0.13 | 0.001 | 0.005 | 0.91 | 0.14 | Comp. ex. |
| 30 | 0.67 | 2.40 | 0.84 | 0.006 | 0.005 | 0.98 | 0.07 | 0.31 | 0.14 | 0.002 | 0.003 | 0.91 | 0.45 | Comp. ex. |
| 31 | 0.74 | 2.16 | 0.89 | 0.007 | 0.007 | 0.93 | 0.13 | 0.12 | 0.01 | 0.002 | 0.003 | 1.02 | 0.12 | Comp. ex. |
| 32 | 0.72 | 2.21 | 0.90 | 0.008 | 0.003 | 0.91 | 0.10 | 0.12 | 0.31 | 0.002 | 0.003 | 1.00 | 0.42 | Comp. ex. |
| 33 | 0.70 | 2.24 | 0.52 | 0.008 | 0.005 | 0.97 | 0.05 | 0.09 | 0.10 | 0.003 | 0.005 | 0.57 | 0.18 | Comp. ex. |
| 34 | 0.74 | 2.08 | 1.17 | 0.006 | 0.005 | 0.93 | 0.14 | 0.12 | 0.15 | 0.003 | 0.004 | 1.31 | 0.27 | Comp. ex. |
| 35 | 0.71 | 2.34 | 1.01 | 0.005 | 0.007 | 1.02 | 0.08 | 0.05 | 0.07 | 0.002 | 0.004 | 1.09 | 0.12 | Comp. ex. |
| 36 | 0.71 | 2.18 | 1.04 | 0.005 | 0.005 | 1.10 | 0.15 | 0.15 | 0.27 | 0.002 | 0.004 | 1.19 | 0.42 | Comp. ex. |

Underlines indicate outside scope of present invention.

Tables 3 and 4 show the production conditions. Some drawn wire materials were heated continuously in a heating furnace (radiant heating furnace), passed through an oil tank for quenching, and passed through a heated lead tank etc. for tempering, that is, oil temper treatment (OT treatment) for quenching and tempering treatment. In this case, the temperature of the heating furnace through which the drawn wire materials were passed was made 950° C., the heating time was made 150 seconds, and the temperature of the oil tank was made 50° C.

Further, in induction quenching tempering treatment (IQT treatment) where the drawn wire material is heated by induction heating, quenched in water, and continuously heated again by induction heating for tempering, the heating temperature was made 1000° C. and the heating time was made 15 seconds. The drawn wire material after quenching was heated at 400 to 500° C. for 1 minute for tempering to adjust the tensile strength.

Note that, the "-" in the columns of the heating temperature before quenching and the heat treatment method in Table 4 mean that the wire broke during drawing and therefore quenching and tempering treatment was not performed (Nos. 30, 32, and 36).

TABLE 3

| No. | Rolling Heating temperature (° C.) | Patenting Heating temperature (° C.) | Quenching Heating temperature (° C.) | Heat treatment method |
|---|---|---|---|---|
| 1 | 1200 | 930 | 1010 | IQT treatment |
| 2 | 1200 | 930 | 950 | OT treatment |
| 3 | 1200 | 930 | 950 | OT treatment |
| 4 | 1200 | 930 | 950 | OT treatment |
| 5 | 1200 | 930 | 1010 | IQT treatment |
| 6 | 1200 | 930 | 1010 | IQT treatment |
| 7 | 1200 | 930 | 950 | OT treatment |
| 8 | 1200 | 930 | 1010 | IQT treatment |
| 9 | 1200 | 930 | 950 | OT treatment |
| 10 | 1200 | 930 | 950 | OT treatment |
| 11 | 1200 | 930 | 950 | OT treatment |
| 12 | 1200 | 930 | 950 | OT treatment |
| 13 | 1200 | 930 | 950 | OT treatment |
| 14 | 1200 | 930 | 950 | OT treatment |
| 15 | 1200 | 930 | 950 | OT treatment |
| 16 | 1200 | 930 | 950 | OT treatment |
| 17 | 1200 | 930 | 950 | OT treatment |
| 18 | 1200 | 930 | 950 | OT treatment |

TABLE 4

| No. | Rolling Heating temperature (° C.) | Patenting Heating temperature (° C.) | Quenching Heating temperature (° C.) | Heat treatment method |
|---|---|---|---|---|
| 19 | 1200 | 950 | 950 | OT treatment |
| 20 | 1200 | 950 | 950 | OT treatment |
| 21 | 1200 | 950 | 950 | OT treatment |
| 22 | 1200 | 950 | 950 | OT treatment |
| 23 | 1200 | 950 | 950 | OT treatment |
| 24 | 1200 | 950 | 950 | OT treatment |
| 25 | 1200 | 950 | 950 | OT treatment |
| 26 | 1200 | 950 | 950 | OT treatment |
| 27 | 1200 | 950 | 950 | OT treatment |
| 28 | 1200 | 950 | 950 | OT treatment |
| 29 | 1200 | 950 | 950 | OT treatment |
| 30 | 1200 | 950 | — | — |
| 31 | 1200 | 950 | 950 | OT treatment |
| 32 | 1200 | 950 | — | — |
| 33 | 1200 | 950 | 950 | OT treatment |

TABLE 4-continued

| No. | Rolling Heating temperature (° C.) | Patenting Heating temperature (° C.) | Quenching Heating temperature (° C.) | Heat treatment method |
|---|---|---|---|---|
| 34 | 1200 | 950 | 950 | OT treatment |
| 35 | 1200 | 950 | 950 | OT treatment |
| 36 | 1200 | 950 | — | — |

Underlines indicate outside scope of present invention.

Samples were taken from the obtained steel wires for spring and used for evaluation of the prior-austenite grain size, volume percent of retained austenite, and carbides, a tensile test, notched bending test, and Vicker's hardness test.

The fatigue properties were evaluated after treatment simulating spring production (hereinafter referred to as "spring production treatment"), heat treatment simulating nitridation performed on a spring after working (500° C., 60 minutes), shot peening (cut wire diameter of 0.6 mm, 20 minutes), and low temperature stress-relieving treatment (180° C., 20 minutes).

The prior-austenite grain size number was measured based on JIS G 0551. The circle equivalent diameter and density of presence of carbides were measured using samples which were electrolytically etched, photographed in structure by SEM, and image processed.

The volume percent of the retained austenite was measured by the magnetic measurement method.

The Vicker's hardness was measured based on JIS Z 2244. Further, the Vicker's hardness of a sample heat treated by being held at 500° C. for 1 hour as heat treatment simulating high temperature nitridation was also similarly measured. A No. 9 test piece of JIS Z 2201 was used for measurement based on JIS Z 2241.

The fatigue test is a Nakamura type rotary bending fatigue test. The maximum load stress where 10 samples exhibit a lifetime of $10^7$ cycles or more at a probability of 50% or more was made the average fatigue strength.

Figure 2:
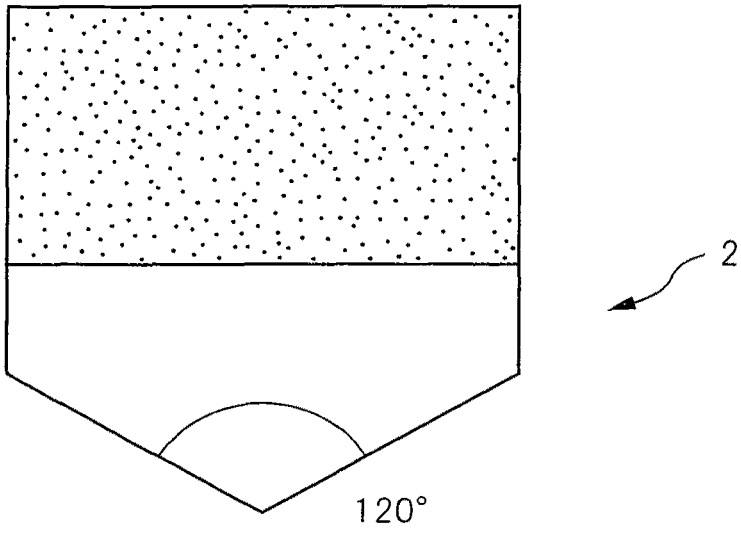
FIG. 2 is a view showing the shape of a punch providing a notch in a test piece.
Figure 3:
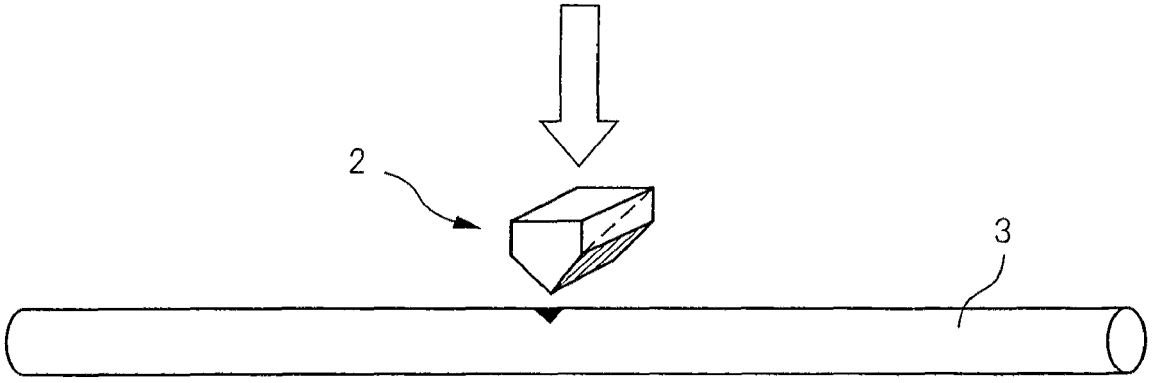
FIG. 3 is a view showing a step of providing a notch in a test piece.

The notched bending test is a test for evaluating the cold coilability and was performed as follows: Using a punch 2, shown in FIG. 2, having a front angle of 120°, a notch of a maximum depth of 30 μm was made in the test piece. Note that, as shown in FIG. 3, the notch was provided perpendicular to the long direction at the center of the long direction of the test piece 3.

Figure 4:
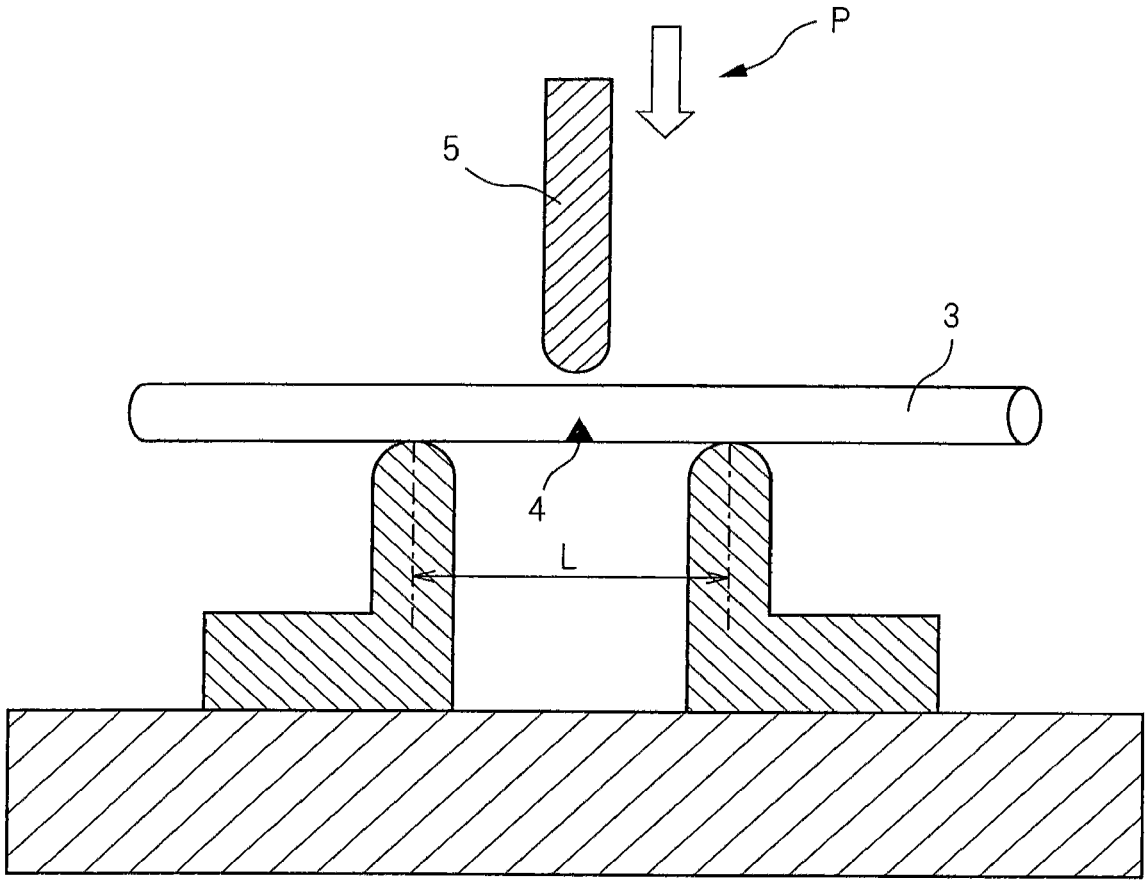
FIG. 4 is a view showing a summary of a notched bending test.

Next, as shown in FIG. 4, a load P of the maximum tensile stress was applied from the side opposite to the notch 4 by a pushing tool 5 for 3-point deformation. Note that, the bending radius r of the front end of the pushing tool was made 4.0 mm, while the distance L between supports was made L=2r+3D. Here, "D" is the diameter of the test piece.

Figure 5:
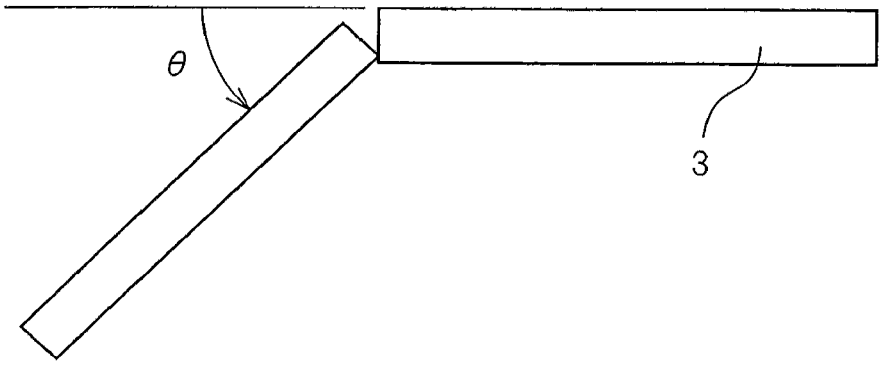
FIG. 5 is a view showing a method of measurement of a notched bending angle.

Bending deformation was applied continuously until the sample fractured from the notched part. The bending angle at the time of fracture (notched bending angle) was measured as shown in FIG. 5.

Note that, when the test piece was separated, the fractured parts were put together to measure the notched bending angle. In the present invention, a sample with a notched bending angle of 28° or more was judged to have an excellent cold coilability.

Tables 5 and 6 show the prior-austenite grain size number, amount of retained austenite (vol %), circle equivalent diameter and density of presence of carbides, tensile strength, notched bending angle, average fatigue strength, and Vicker's hardness before and after annealing.

TABLE 5

| No. | Microstructure: Prior-austenite Crystal grain size no. | Microstructure: Retained austenite % | Spheroidal carbides: 0.2 to 0.5 μm*1 particles/μm² | Spheroidal carbides: >0.5 μm*2 particles/μm² | Tensile properties: Tensile strength MPa | Tensile properties: 0.2% proof strength MPa | Cold coilability Notched bending deg. | Fatigue strength Nakamura-type rotary bending MPa | Temper softening properties: Before heat treat. HV | Temper softening properties: After heat treat. HV | Remarks |
|---|---|---|---|---|---|---|---|---|---|---|---|
| 1 | 10 | 11.6 | 0.02 | 0.01 | 2205 | 1562 | 32 | 814 | 607 | 584 | Inv. ex. |
| 2 | 11 | 9.6 | 0.05 | | 2185 | 1472 | 36 | 806 | 604 | 585 | Inv. ex. |
| 3 | 11 | 10.6 | 0.03 | 0.01 | 2175 | 1610 | 33 | 817 | 605 | 592 | Inv. ex. |
| 4 | 11 | 6.1 | 0.04 | | 2161 | 1575 | 34 | 801 | 599 | 579 | Inv. ex. |
| 5 | 11 | 12.5 | 0.05 | | 2243 | 1611 | 33 | 816 | 624 | 604 | Inv. ex. |
| 6 | 12 | 7.0 | 0.05 | 0.01 | 2163 | 1792 | 34 | 806 | 599 | 585 | Inv. ex. |
| 7 | 12 | 12.4 | 0.03 | | 2283 | 1722 | 30 | 794 | 630 | 593 | Inv. ex. |
| 8 | 11 | 7.3 | 0.02 | | 2272 | 1794 | 34 | 794 | 625 | 595 | Inv. ex. |
| 9 | 10 | 6.2 | 0.03 | 0.01 | 2277 | 1616 | 34 | 808 | 627 | 597 | Inv. ex. |
| 10 | 12 | 8.4 | 0.06 | | 2187 | 1785 | 34 | 812 | 603 | 578 | Inv. ex. |
| 11 | 13 | 10.9 | 0.04 | | 2210 | 1586 | 34 | 797 | 610 | 592 | Inv. ex. |
| 12 | 10 | 11.4 | 0.05 | 0.01 | 2187 | 1500 | 32 | 813 | 608 | 589 | Inv. ex. |
| 13 | 12 | 12.1 | 0.03 | | 2254 | 1791 | 35 | 801 | 627 | 584 | Inv. ex. |
| 14 | 12 | 8.0 | 0.05 | | 2108 | 1571 | 38 | 799 | 588 | 575 | Inv. ex. |
| 15 | 11 | 11.1 | 0.04 | 0.01 | 2160 | 1539 | 37 | 818 | 601 | 589 | Inv. ex. |
| 16 | 13 | 9.2 | 0.04 | 0.01 | 2223 | 1767 | 35 | 818 | 604 | 593 | Inv. ex. |
| 17 | 11 | 11.9 | 0.06 | | 2141 | 1484 | 38 | 800 | 593 | 576 | Inv. ex. |
| 18 | 10 | 6.8 | 0.03 | | 2280 | 1824 | 31 | 807 | 631 | 602 | Inv. ex. |

*1Density of presence of circle equivalent diameter 0.2 to 0.5 μm spheroidal carbides.
*2Density of presence of circle equivalent diameter over 0.5 μm spheroidal carbides, blank cells mean density of presence less than 0.01 particles/μm².

TABLE 6

| No. | Microstructure: Prior-austenite Crystal grain size no. | Microstructure: Retained austenite % | Spheroidal carbides: 0.2 to 0.5 μm*1 particles/μm² | Spheroidal carbides: >0.5 μm*2 particles/μm² | Tensile properties: Tensile strength MPa | Tensile properties: 0.2% proof strength MPa | Cold coilability Notched bending deg. | Fatigue strength Nakamura type rotary bending MPa | Temper softening properties: Before heat treat. HV | Temper softening properties: After heat treat. HV | Remarks |
|---|---|---|---|---|---|---|---|---|---|---|---|
| 19 | 13 | 2.1 | 0.06 | | 2089 | 1337 | 35 | 776 | 550 | 513 | Comp. ex. |
| 20 | 13 | 16.0 | 0.08 | 0.02 | 2234 | 1866 | 28 | 788 | 616 | 595 | Comp. ex. |
| 21 | 13 | 11.6 | 0.03 | | 2234 | 1301 | 32 | 777 | 605 | 527 | Comp. ex. |
| 22 | 13 | 9.9 | 0.03 | | 2219 | 1498 | 27 | 774 | 612 | 590 | Comp. ex. |
| 23 | 11 | 2.3 | 0.03 | | 2296 | 2208 | 27 | 797 | 632 | 556 | Comp. ex. |
| 24 | 11 | 16.0 | 0.02 | 0.01 | 2108 | 1831 | 27 | 803 | 621 | 598 | Comp. ex. |
| 25 | 12 | 8.8 | 0.02 | | 2089 | 1570 | 34 | 779 | 545 | 513 | Comp. ex. |
| 26 | 10 | 11.3 | 0.12 | | 2288 | 1811 | 22 | 801 | 605 | 593 | Comp. ex. |
| 27 | 9 | 3.2 | 0.06 | | 2191 | 1548 | 32 | 773 | 592 | 529 | Comp. ex. |
| 28 | 12 | 17.1 | 0.09 | 0.01 | 2244 | 1859 | 25 | 775 | 611 | 561 | Comp. ex. |
| 29 | 13 | 7.1 | 0.03 | | 2226 | 1796 | 32 | 774 | 601 | 567 | Comp. ex. |
| 30 | | | | | — | | | | | | Comp. ex. |
| 31 | 11 | 9.6 | 0.05 | 0.01 | 2209 | 1666 | 36 | 771 | 590 | 548 | Comp. ex. |
| 32 | | | | | — | | | | | | Comp. ex. |
| 33 | 11 | 3.1 | 0.04 | | 2292 | 2086 | 26 | 809 | 630 | 590 | Comp. ex. |
| 34 | 10 | 18.2 | 0.02 | 0.01 | 2254 | 1082 | 27 | 783 | 598 | 556 | Comp. ex. |
| 35 | 10 | 12.3 | 0.04 | | 2139 | 1520 | 34 | 776 | 573 | 549 | Comp. ex. |
| 36 | | | | | — | | | | | | Comp. ex. |

Underlines indicate outside scope of present invention.
*1Density of presence of circle equivalent diameter 0.2 to 0.5 μm spheroidal carbides.
*2Density of presence of circle equivalent diameter over 0.5 μm spheroidal carbides, blank cells mean density of presence less than 0.01 particles/μm².

As shown in Table 5, the high strength steel wire for spring of the present invention is high in tensile strength, excellent in cold coilability, excellent in temper softening properties, and, further, excellent in fatigue properties after spring production treatment (hereinafter referred to as the "spring fatigue properties"). Therefore, it was confirmed that if using the high strength steel wire for spring of the present invention as an example, it is possible to produce a high strength spring excellent in fatigue properties.

On the other hand, Table 6 shows comparative examples outside the scope of the present invention.

No. 19 is an example with an insufficient amount of C, so fell in strength. The spring fatigue properties and temper softening resistance also fall. Note that, No. 19 has a low tensile strength, so the retained austenite is small, but the cold coilability is excellent. On the other hand, No. 20 is excessive in amount of C. It is high in strength, but the spheroidal carbides increase and coarsen, the amount of retained austenite increases, and the cold coilability and spring fatigue properties fall.

No. 21 is an example with a small amount of Si, so falls in temper softening resistance. On the other hand, No. 22 is an example with an excessive amount of Si, so fell in cold coilability.

Further, No. 23 is an example with a small amount of Mn and insufficient retained austenite, so fell in cold coilability. On the other hand, No. 24 is an example with an excessive amount of Mn and increased retained austenite, so fell in cold coilability due to the formation of strain induced martensite.

No. 25 is an example with a small amount of Cr, so fell in strength. On the other hand, No. 26 is an example with an excessive amount of Cr, so increased in relatively fine spheroidal carbides and fell in cold coilability and spring fatigue properties.

Further, No. 27 is an example with a small amount of V, a large grain size of prior-austenite, and insufficient retained austenite. In this case, the coilability etc. are excellent, but the spring fatigue properties was insufficient and, further, the hardness after annealing was also not sufficient. No. 28 is an example with a large V, excessive formation of retained austenite, and increased relatively fine spheroidal carbides, and therefore fell in cold coilability. Further, the spring fatigue properties after annealing were also inferior to those of the invention examples. Large amounts of V were consumed in the undissolved carbides, so the hardness at the time of annealing is also not sufficient.

No. 29 is an example with a small amount of Mo, while No. 31 is an example with a small amount of W, so both have deteriorated temper softening resistance. On the other hand, No. 30 is an example with a small amount of Mo, while No. 32 is an example with a large amount of W, so both broke at the time of drawing and could not give high strength steel wires for spring. No. 35 is an example with a small total of contents of Mo and W, so has deteriorated temper softening resistance. The fatigue strength is also insufficient. On the other hand, No. 36 is an example with a large total of contents of Mo and W, so broke at the time of drawing and could not give a high strength steel wire for spring.

No. 33 is an example with a small total of contents of Mn and V and insufficient retained austenite, so fell in cold coilability. On the other hand, No. 34 is an example of a large total of contents of Mn and V and an increased amount of retained austenite, so fell in cold coilability due to strain induced martensite.

INDUSTRIAL APPLICABILITY

As explained above, according to the present invention, it is possible to provide high strength steel wire for spring excellent in cold coilability and excellent in softening resistance, so can give high strength springs excellent in durability and contributes to the reduction in size of machine components using springs. The present invention has a high value of utilization in industry.

| Reference Signs List | |
|---|---|
| 1: | spheroidal carbides |
| 2: | punch |
| 3: | test piece |
| 4: | notch |
| 5: | pushing tool |
| P: | load |
| L: | distance between supports |
| θ: | notched bending angle |

The invention claimed is:

1. High strength steel wire for spring containing, by mass %,

C: more than 0.70 and less than 0.75%,

Si: 2.0 to 2.5%,

Mn: 0.5 to 1.2%,

Cr: 0.8 to 1.3%,

V: 0.03 to 0.10%,

Mo: 0.05 to 0.25%,

W: 0.05 to 0.30%, and

N: 0.003 to 0.007%, having a total of contents of Mn and V of 0.70%≤Mn+V≤1.27% and a total of contents of Mo and W of 0.13%≤Mo+W≤0.35%, limiting P: 0.025% or less, S: 0.025% or less, and Al: 0.003% or less, and having a balance of iron and unavoidable impurities, having a microstructure comprised of, by volume percent, over 6% to 15% of retained austenite and tempered martensite, having a prior-austenite grain size number of 10 or more, having a density of presence of spheroidal carbides with a circle equivalent diameter of 0.2to 0.5 μm of 0.06 particles/$\mu m^2$ or less, having a density of presence of spheroidal carbides with a circle equivalent diameter of over 0.5 μm of 0.01 particles/$\mu m^2$ or less, and having a tensile strength of 2100 to 2350 MPa.

2. High strength steel wire for spring as set forth in claim 1, wherein the yield strength is 1470 to 1980 MPa.

3. High strength steel wire for spring as set forth in claim 1 or 2, wherein a Vicker's hardness after heat treatment holding the wire at 500° C. for 1 hour is 570 or more.

* * * * *

UNITED STATES PATENT AND TRADEMARK OFFICE

CERTIFICATE OF CORRECTION

PATENT NO. : 8,734,600 B2
APPLICATION NO. : 13/261124
DATED : May 27, 2014
INVENTOR(S) : Masayuki Hashimura et al.

It is certified that error appears in the above-identified patent and that said Letters Patent is hereby corrected as shown below:

In the Specification:

Column 2, line 51, change "add No and W" to -- add Mo and W --;

Column 2, line 52, change "contents of No and W" to -- contents of Mo and W --;

In the Claims:

Column 20, line 40, change "of 0.2to 0.5 μm" to -- of 0.2 to 0.5 μm --.

Signed and Sealed this
Twenty-eighth Day of October, 2014

Michelle K. Lee

Michelle K. Lee
*Deputy Director of the United States Patent and Trademark Office*